US006202358B1

(12) United States Patent
Janesky

(10) Patent No.: US 6,202,358 B1
(45) Date of Patent: Mar. 20, 2001

(54) RAIN CHUTE

(76) Inventor: Lawrence M. Janesky, 11 Fawn Meadow La., Huntington, CT (US) 06484

( * ) Notice: Subject to any disclaimer, the term of this patent is extended or adjusted under 35 U.S.C. 154(b) by 0 days.

(21) Appl. No.: 09/434,991

(22) Filed: Nov. 5, 1999

(51) Int. Cl.[7] ..... E04D 13/08; E01C 11/22

(52) U.S. Cl. ..... 52/16; 52/11; 52/102; 47/33; 239/208; 404/2; 404/7

(58) Field of Search ..... 52/11, 16, 102, 52/169.5; 239/208, 197; 404/2–4, 7–8; 47/32, 33; 405/115, 119, 43

(56) References Cited

U.S. PATENT DOCUMENTS

| | | | | |
|---|---|---|---|---|
| 643,677 | * | 2/1900 | Payne | 404/2 |
| 2,334,779 | * | 11/1943 | Luff | 52/16 X |
| 2,814,529 | * | 11/1957 | Arnt | 239/208 |
| 2,898,839 | * | 8/1959 | Fox | 52/16 |
| 3,035,779 | * | 5/1962 | Convis | 239/208 X |
| 3,636,830 | * | 1/1972 | Watts | 47/33 X |
| 3,745,701 | * | 7/1973 | Marvin | 47/33 |
| 5,377,447 | * | 1/1995 | Fritch | 52/102 X |
| 5,640,801 | * | 6/1997 | Rynberk | 52/102 X |

* cited by examiner

*Primary Examiner*—Carl D. Friedman
*Assistant Examiner*—Winnie Yip
(74) *Attorney, Agent, or Firm*—Perman & Green, LLP

(57) ABSTRACT

An elongate ground gutter device designed to be substantially recessed in the ground with the central trough section thereof open above ground. The gutter device is designed to communicate with the downspout of a roof gutter to receive rain water into the trough section and transport it a distance away from the building. The gutter device comprises a trough section having vertical walls terminating in upper reinforcement sections which are supported on the ground surface, and a pair of lower horizontal flanges which are buried below ground, parallel to and underlying the reinforcement sections.

5 Claims, 1 Drawing Sheet

RAIN CHUTE

BACKGROUND OF THE INVENTION

1. Field of the Invention

The present invention relates to a novel means for diverting water such as rainwater from roof gutter downspouts away from the foundation of the building in order to prevent water damage and erosion to the foundation and to reduce the accumulation of water at the footing of the foundation. Such accumulation can migrate or seep into the basement of the building, causing dampness and water damage, and can travel beneath the basement floor and generate water pressures which can result in cracking of the floor and expensive damage.

2. State of the Art

It is known to provide the downstream exit of drainpipes with elbows which discharge the rain water in a direction away from the foundation, and to incorporate a drain block or slab onto which the elbow discharges in order to reduce erosion of the soil and grass at the point of water discharge by providing a cement or plastic drain block surface which receives the effect of the water flow and fans out the water discharge to some extent.

While such devices are effective for reducing water erosion of the soil and lawn, they are not effective in substantially reducing the seepage and accumulation of downspout water adjacent the foundation of the building since they do not transport the water more than a few feet away from the foundation. Moreover these devices sit upon the surface of the soil or lawn and present obstructions to a lawnmower or tractor, and can be damaged thereby or dislodged.

It is also known to attach above-ground drainpipe extensions to downspout elbows in order to transport the rainwater far enough away from the foundation to preclude seepage and accumulation of the rain water in the area of the foundation. Such extensions are supported on or above the surface of the lawn, are unsightly, present an obstruction to the cutting of the lawn and can be damaged or dislodged by lawnmowers and tractors and by foot traffic. Moreover, such extensions can become clogged with leaves and other debris discharged from the roof gutter. Also, water accumulated therein can freeze in cold climates.

Finally, it is known to connect downspout elbows to buried drainpipe extensions, such as lengths of polyvinyl chloride (PVC) piping having a downstream discharge end opening into a dry well or above ground at a lower surface level. While such buried drainpipe extensions are not unsightly and do not present obstructions to the cutting of the lawn or to foot traffic, they do have the other disadvantages of the above-ground extensions, namely, they can become clogged and blocked by leaves and other debris, and also can freeze in cold climates.

Therefore there is a need for a fixed downspout extension for transporting roof gutter water away from the building foundation while not obstructing the cutting of the lawn, or foot traffic, and while preventing clogging and freezing of the extension.

SUMMARY OF THE INVENTION

The present invention relates to an elongate ground gutter device for receiving rain water from a roof gutter downspout and for transporting the rain water for discharge a substantial distance away from the building foundation, such as seven or more feet, to preclude return of the rain water to the area of the foundation. The present ground gutter device preferably comprises an elongate polyvinyl chloride (PVC) plastic extrusion having a central elongate open trough section enclosed on both sides by an opposed pair of vertical short walls, the upper ends of each of which terminate in a reinforced overhang portion. The extrusion also comprises an opposed pair of elongate horizontal narrow flanges which are substantially coplanar with the base of the central trough section and which extend outwardly therefrom.

The present ground gutter devices are designed to be mounted into the surface of the ground so that the central trough section is recessed below ground level, the opposed horizontal flanges are buried in the soil to anchor the device in place, and the reinforced overhang sections of the vertical side walls extend at ground level to permit the passage of a lawnmower or tractor over the open trough section without damage to the device.

The installed device is fixed in place, resistant to any dislodgment, and is not readily visible from a distance, particularly if it is green in color to match the color of the lawn.

Generally the ground or backfill adjacent the foundation of a building is graded away from the foundation, and the present ground gutter device is installed in the ground, with the inlet end of the device communicating with the outlet end of a downspout, and the elongate device is inclined away from the building to cause the discharged rain water to flow to the outlet or discharge end of the device, away from the foundation. The discharge end can be open to a lower ground level. The side walls and reinforced overhang sections can be tapered down to the floor of the trough section, at the discharge end, to prove a smoother downslope interface if desired.

BRIEF DESCRIPTION OF THE DRAWINGS

The foregoing aspects and other features of the present invention are explained in the following description, taken in connection with the accompanying drawings, wherein.

DETAILED DESCRIPTION

Figure 1:
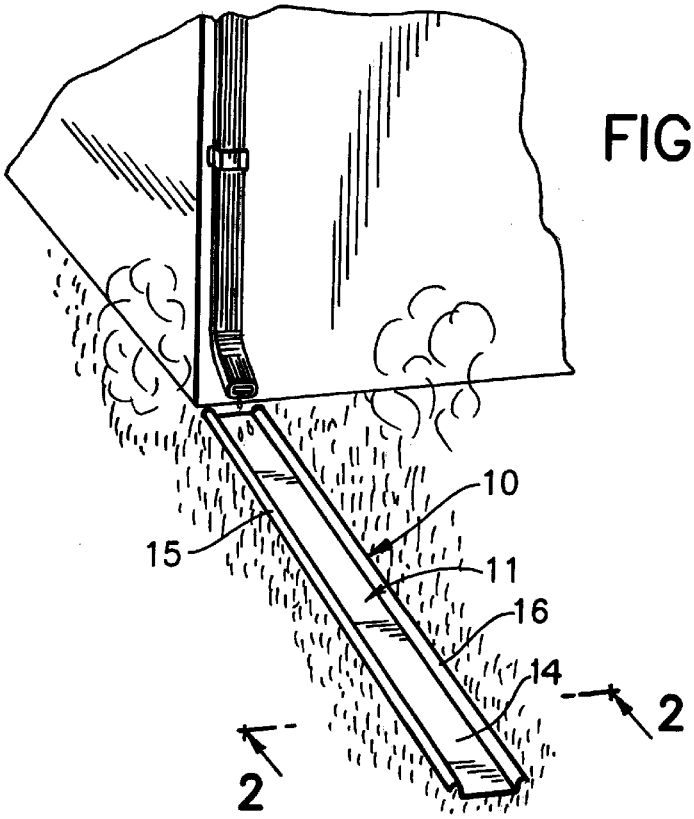
FIG. 1 is a perspective view of the present ground gutter device, installed in communication with the outlet elbow section of a roof gutter downspout of a building.

As illustrated by FIG. 1, the present ground gutter device 10 comprises a strong, elongate, unitary element, preferably an extrusion of a suitable molding plastic composition such as polyvinyl chloride (PVC), polypropylene, nylon or other pliable, non-brittle polymer composition. The device 10 comprises a central gutter or trough section 11 enclosed by a pair of vertical short side walls 12 and 13 which extend from the floor 14 of the trough section 11 and which terminate at their upper ends with integral wide overhang flanges or tubular reinforcements 15 and 16. The device is extruded with lower horizontal side flanges 17 and 18 which preferably are substantially co-planer with the floor 14 of the trough section 11 and which are buried in the ground to anchor and stabilize the installed device against dislodgment upon contact with lawnmowers and foot traffic.

Figure 2:
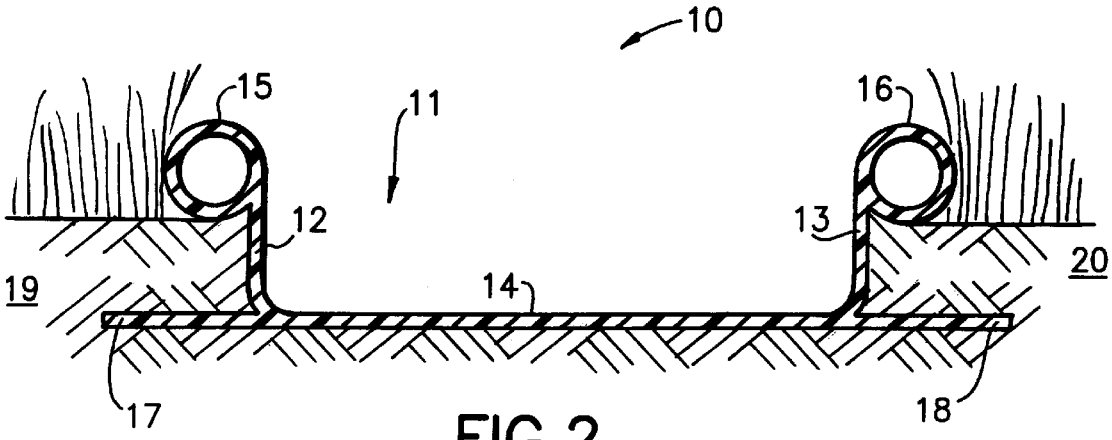
FIG. 2 is a cross-sectional view of the present ground gutter device, illustrating the device in installed position in the ground.

As illustrated by FIG. 2, the preferred design for the present ground gutter devices 10 comprises upper side wall reinforcements 15 and 16 in the form of tubular elements which are offset outwardly from the vertical plane of the side walls 12 and 13 so as to overhang and overlie the lower horizontal flanges 17 and 18, respectively. This provides ground-fill support areas 19 and 20, respectively, between the undersurfaces of the tubular reinforcements 15 and 16 and the upper surfaces of the horizontal flanges 17 and 18 whereby downward pressures exerted against the tubular elements 15 and 16 are cushioned by the soil within the support areas which becomes compressed against the horizontal flanges 17 and 18. This design reinforces the vertical side walls against breakage under the effect of downward pressures such as the weight of a tractor or foot traffic.

It should be understood that while the present ground gutter devices preferably are extruded as integral strong plastic elements, such as having a wall thickness between about 1/16 inch and 3/16 inch, having the structure illustrated in the drawings, the present devices can be extruded or molded in two pieces such as the walled trough section and a flat base panel which is bonded thereto to provide the horizontal flanges, 17 and 18. Alternatively, the present ground gutter devices can be extruded from metal, such as aluminum, or formed from fiberglass panels which are heat-molded to the required configuration.

Also, while the hollow tubular reinforcements 15 and 16 of pliable PVC, having a diameter of between about ½ inch and ¾ inch, are preferred for their cushioning properties, it should be understood that solid bead reinforcements are suitable, as well as narrow horizontal top flanges which extend parallel to the bottom flanges 17 and 18.

Preferred dimensions for the present devices 10 comprise a trough 11 width of between about 4 and 7 inches; a trough depth of between about ½ and 2 inches, from floor 14 to the tops of the reinforcements 15 and 16; reinforcement 15,16 widths or diameters of between about ½ and 1 inch, and horizontal flange 17,18 widths of between about 1 and 2 inches outwardly of the vertical walls 12 and 13. The present gutter devices preferably are extruded in continuous lengths and cut into desired lengths, such as 4,6,8 or more feet. Also they can be formed with or provided with end connectors to permit lengths thereof to be joined together.

As is clear from the foregoing, the present ground gutter device is designed to be recessed into the surface of the ground, but not under the ground, so as to present no obstacle to cutting of the lawn or to foot traffic, and to be visually-unobjectionable. More importantly, the central trough or gutter section, while recessed below ground, is open at the top to permit inspection and any deposited leaves or other debris, snow or ice, can be cleared away in simple fashion with a broom or similar device to maintain the trough open for the conveyance of water away from the downspout and foundation.

While the invention has been described in detail with reference to specific preferred embodiments, it will be appreciated that various modifications may be made from the specific details without departing from the spirit and scope of the invention.

What is claimed is:

1. An elongate ground gutter device for transporting and discharging rain water from a house gutter downspout to a location remote from a foundation, comprising a central trough section having a floor section and a pair of opposed vertical side walls, each side wall terminating in an upper reinforcement section which extends outwardly of the trough section, a pair of opposed horizontal flanges extending outwardly from adjacent the floor section of the trough section, spaced below the upper reinforcement sections of the side walls to provide spaces therebetween, the ground gutter device being designed to be mounted with the horizontal flanges and the vertical walls of the central trough section buried in the soil, up to the underside of the reinforcement sections, so that the trough is open to the atmosphere and the reinforcement sections are cushioned against downward pressures by soil present in the spaces between said sections and said horizontal flanges to strengthen and stabilize the installed ground gutter device.

2. A device according to claim 1 comprising an integral extrusion of pliable resinous molding composition.

3. A device according to claim 2 extruded from green-colored polyvinyl chloride molding composition.

4. A device according to claim 1 in which the upper reinforcement section of each side wall is in the form of a rounded tubular section having a diameter of at least about ½ inch.

5. A device according to claim 4 in which each tubular section is hollow.

* * * * *